US005865339A

United States Patent [19]

Carlson

[11] Patent Number: 5,865,339

[45] Date of Patent: Feb. 2, 1999

[54] CONTAINER AND TAGS

[75] Inventor: Arthur Richard Carlson, Melbourne, Australia

[73] Assignee: The Decor Corporation Pty Ltd, Australia

[21] Appl. No.: 750,884

[22] PCT Filed: Jun. 13, 1995

[86] PCT No.: PCT/AU95/00346

§ 371 Date: Dec. 13, 1996

§ 102(e) Date: Dec. 13, 1996

[87] PCT Pub. No.: WO95/34878

PCT Pub. Date: Dec. 21, 1995

[30] Foreign Application Priority Data

Jun. 15, 1994 [AU] Australia ..... PM6222

[51] Int. Cl.[6] ..... B65D 79/00

[52] U.S. Cl. ..... 220/694; 206/459.1; 206/459.5; 206/464; 206/466; 206/831

[58] Field of Search ..... 206/459.1, 831, 206/466, 464; 220/694, 200

[56] References Cited

U.S. PATENT DOCUMENTS

| | | | |
|---|---|---|---|
| 1,853,622 | 4/1932 | Kennedy | 206/831 |
| 3,907,110 | 9/1975 | Weber et al. | 206/459.5 |
| 4,099,611 | 7/1978 | Feibelman | 206/464 |
| 4,301,941 | 11/1981 | Kraft | 206/459.5 |
| 4,312,449 | 1/1982 | Kinderman | 206/466 |
| 4,877,119 | 10/1989 | Hosking | 206/459.1 |
| 4,941,573 | 7/1990 | Fuerstman | 206/459.5 |

FOREIGN PATENT DOCUMENTS

| | | |
|---|---|---|
| AU-A-18161/83 | 2/1984 | Australia . |
| 2-634-574 | 7/1988 | France . |
| 411556 | 12/1932 | United Kingdom . |
| 2257109 | 6/1993 | United Kingdom . |
| WO 90/05352 | 5/1990 | WIPO . |
| WO 93/17412 | 9/1993 | WIPO . |

*Primary Examiner*—Joseph M. Moy

*Attorney, Agent, or Firm*—David S. Resnick; Dike, Bronstein, Roberts & Cushman, LLP

[57] ABSTRACT

A container having a removable indicator tag which is releasably attachable thereto. The tag can be attached to a peripheral rim, pedestal, lid, under a peripheral rim or to the sidewall.

4 Claims, 7 Drawing Sheets

CONTAINER AND TAGS

This invention relates to the attachment of tags to containers so as to indicate a characteristic of the contents of the container and refers particularly, though not exclusively, to the attachment of such tags to domestic containers and canisters.

With the advent of freezers, and use-by dates for foods, it has become important to have methods of indicating the contents of containers in a domestic situation. For example, food can be taken from its package and placed in a container and the package removed for recycling or disposal. In that instance, the new container will have no indication of the use by date. Also, it may be of advantage to have the contents of the container indicated at the same time. This can also be important when freezing pre-prepared foods so that one can determine what is in the container when it was stored, or when it should be consumed.

Common methods employed in the past have been self-adhesive labels. These are all of varying styles, and have met with little success. Although it is easy to attach the label and write upon it, by the very act of freezing the container, or the placement of the container in a microwave oven, the nature of the adhesive is quite often changed and it can be very difficult to remove the labels. Therefore, if the container is washed, part of the label is removed but other parts remain, and in the end an unsightly and unusable mess remains. If washed in a dishwasher, the adhesive label which is partly removed may clog the filter and cause ineffective washing. Also, even if waterproof labels are used, after a small number of uses, the water proofing is removed and they again become unsightly and unusable mess.

In addition, for other forms of containers, ability to be able to easily attach and remove a tag upon which we can write identifying data, would be very helpful. For example, potted plants. Quite often the name, age or other identifying data of a plant is lost. A readily attachable tag would be a solution for seedlings. Such a tag would allow the details of the seedling, date of planting, expected colours, and so forth, to be recorded. Even watering dates, fertilising dates or when anti-fungal or insect sprays have been used, and so forth, could be recorded.

It is therefore the principal object of the present invention to provide a means by which a tag can be releasably attached to a container so as to be able to indicate characteristics of the contents of the container. Such characteristics are to be taken as including the contents of the container themselves, or relevant dates, packaging dates or any other suitable or required characteristics.

With the above and other objects in mind the present invention provides a container having a removable indicator tag, said container adapted to releasably receive said indicator tag in relation thereto, said indicator tag adapted to receive information on the contents of the container.

The invention also provides a domestic container or canister having an open mouth and a lid for sealably closing said container or canister over said open mouth, an external peripheral rim on said container adjacent said mouth, an indicator tag adapted to receive information on the contents of the container, said indicator tag including a first co-operating means at one end or adjacent one end adapted to be associated with a second co-operating means on or adjacent said lid, or on or adjacent or under said rim, said first and second co-operating means allowing said indicator tag to be releasably attached to said domestic container or canister.

The external peripheral rim of the container may take a number of conventional forms, such as a flanged skirt, a substantial solid bead, or, an extension of the side wall of the container of similar or the same dimensions.

In order that the invention may be fully understood there shall now be described preferred constructions of containers and indicator tags incorporating the principal features of the present invention, the description being with reference to the accompanying illustrative drawings in which.

Figure 1:
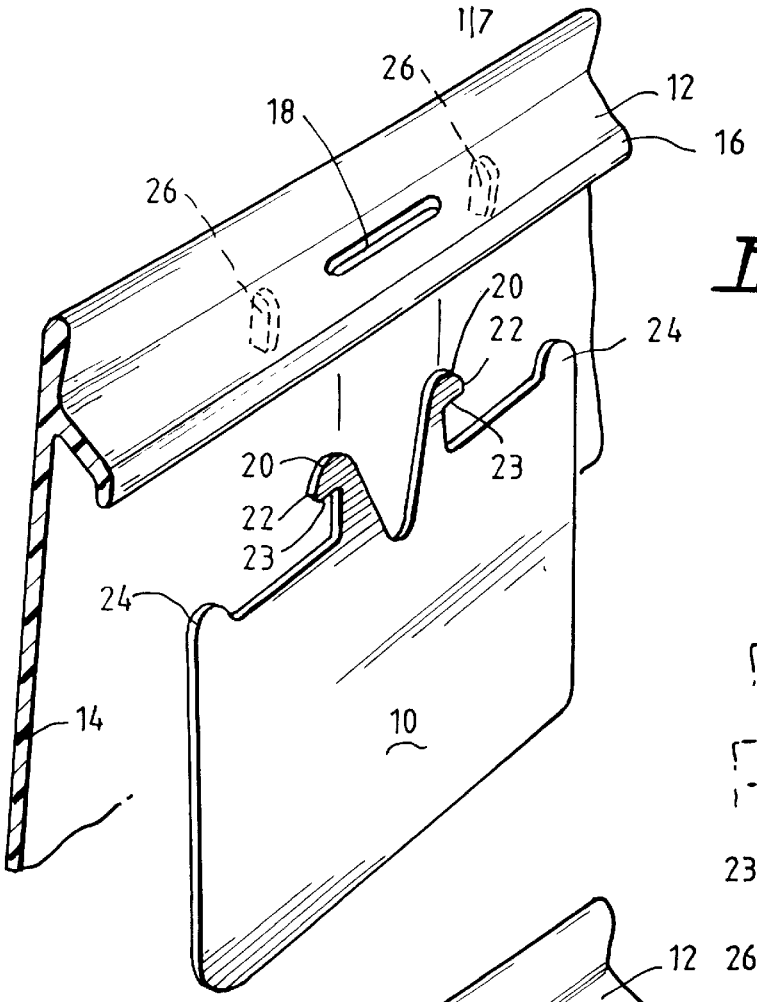
FIG. 1 is an exploded perspective view of an indicator tag of a first embodiment to be attached to a container.
Figure 2:
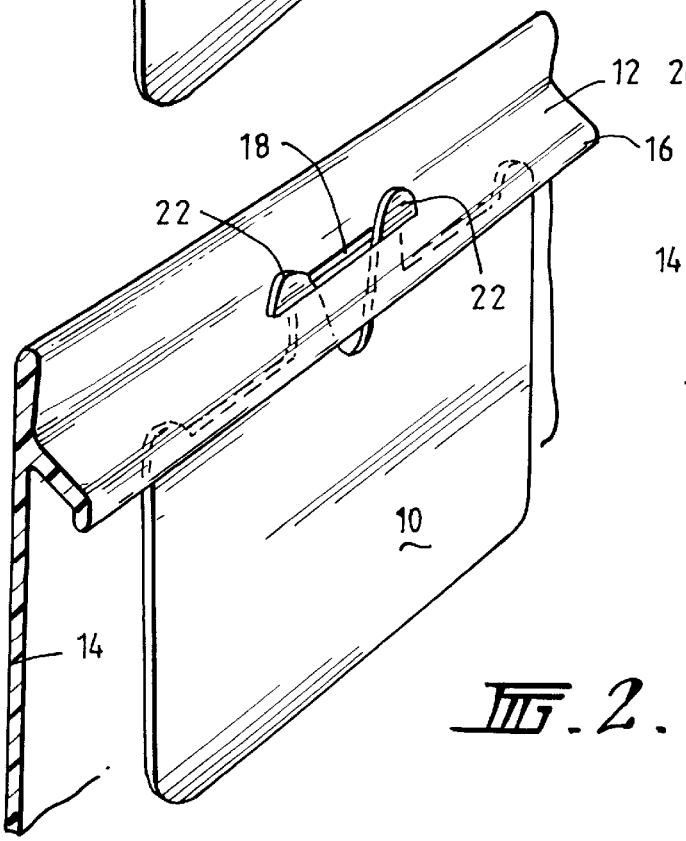
FIG. 2 is a similar view to that of FIG. 1 showing the tag of FIG. 1 as fitted to the container.
Figure 3:
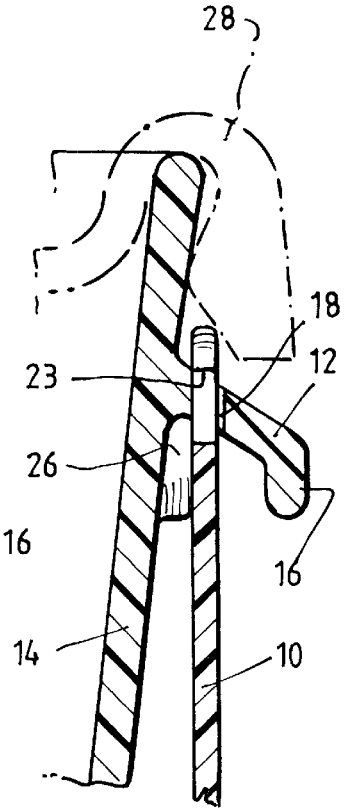
FIG. 3 is a side cross-sectional view of the arrangement of FIG. 2.

To now refer to the embodiment of FIGS. 1 to 3 there is shown a tag generally designated as 10 which is to be attached to the rim 12 of the side wall 14 of a container (not shown) As the construction of the side wall 14 is not relevant for the present considerations, it will not be described. The rim 12 extends outwardly and downwardly and has a skirt 16. The rim 12 has an opening or slot 18 which is adapted to releasably receive two inverted, opposed, L-shaped projections or hook members 20, each of which has an outwardly projecting portion 22 having a flat base 23, which would engage the rim 12 adjacent the opening 18.

The tag 10 is generally of a rectangular shape, although any shape or size could be used. Two lugs 24 are used to assist the tag 10 locating under the rim 12 and to retain the tag 10 in a "snug" fit by gently contacting the underside of rim 12.

In this way, by pressing the two projections 20 together, they can be passed through the opening 18 and then released to resume their unstressed state and contact the rim 12 adjacent the hole 18. Alternatively, in view of the curved shape of the top of the projections 20, merely forcing the projections through the hole 18 would also be satisfactory. To release the tag 10, it is only required to again force the projections 20 towards each other and to remove the tag.

As can be seen from FIG. 1, ribs 26 can also be provided which would serve to accurately locate the tag 10. As can be seen from FIG. 3, the lid 28 which locates on side wall 14, would not interfere with the operation of the tag 10, or the projections 20. Skirt 16 will limit the outward movement of tag 10.

Figure 4:
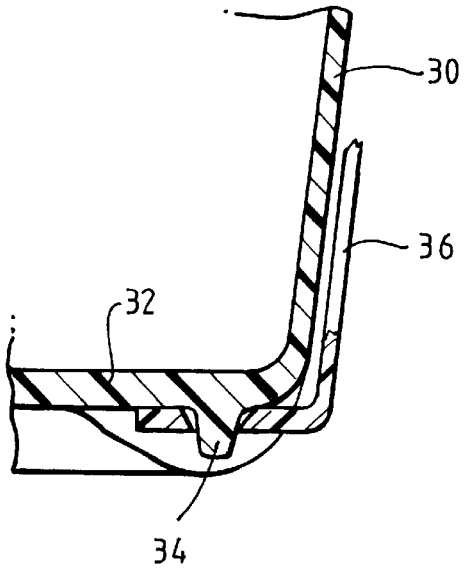
FIG. 4 is a partial cross-sectional view of a second embodiment.

In the embodiment of FIG. 4, there is shown a container which has a side wall 30 and a base 32. The base 32 has a pedestal 34 through which could be located a L-shaped tag 36. The tag 36 would be the same as tag 10 in its operation, but would obviously be shaped to follow the shape of side wall 30 and base 32.

Figure 5:
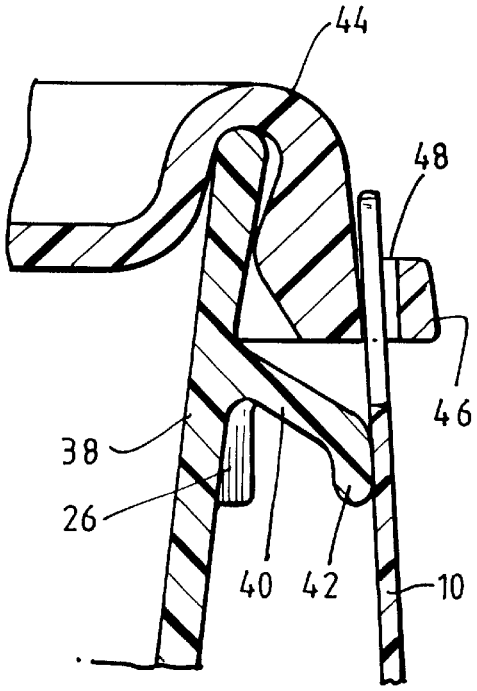
FIG. 5 is a partial cross-sectional view of a third embodiment.

In FIG. 5 there is shown a variation of the embodiment of FIGS. 1 to 3 where there is a side wall 38, a rim 40 and a skirt 42. A lid 44 is provided which attaches on side-wall 38, in the usual manner. The lid has a projection 46 having an opening 48 therethrough into which can be located the tag 50. The tag 50 would operate in the same manner as the tag 10 of the embodiment of FIGS. 1 to 3.

Figure 6:
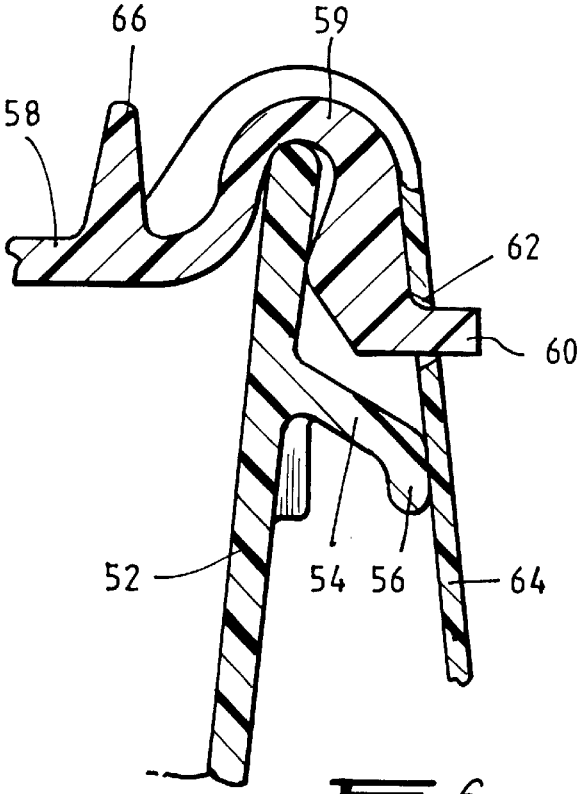
FIG. 6 is a partial cross-sectional view of a fourth embodiment.

In FIG. 6 there is shown a variation of this where there is again a side-wall 52 with a rim 54 and a skirt 56. A lid 58 is provided and which secures to the side-wall 52 in the usual manner. The lid 58 has a projection 60 which protrudes through an opening 62 in tag 64. Tag 64 has a extended portion, similar to the projection 20 of FIGS. 1 to 3, which passes over a bead 59 of lid 58 and engages behind a lug 66 on the lid 58 to be secured in relation thereto.

Figure 7:
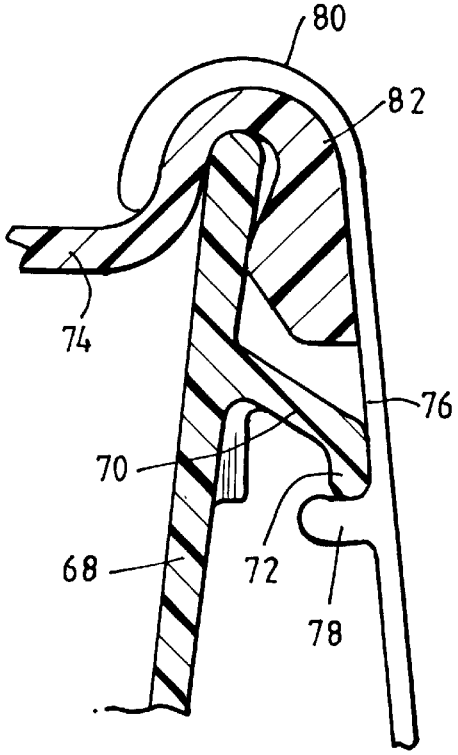
FIG. 7 is a partial cross-section view of a fifth embodiment.

A further variation is shown in the embodiment of FIG. 7 where there is shown a side-wall 68 which has a rim 70 and a skirt 72. A lid 74 engages the side wall 68 in the usual manner. A tag 76 is provided in which has a projecting lug 78 which engages under the skirt 72. The tag 76 also has a curved upper portion 80 which engages over peripheral bead 82 of lid 74. In this way, the tag 76 can be attached to the combination of the lid 74 and container by way of a snap fit after placing the curved portion 80 over bead 82 and engaging the lug 78 under the skirt 72.

Figure 8:
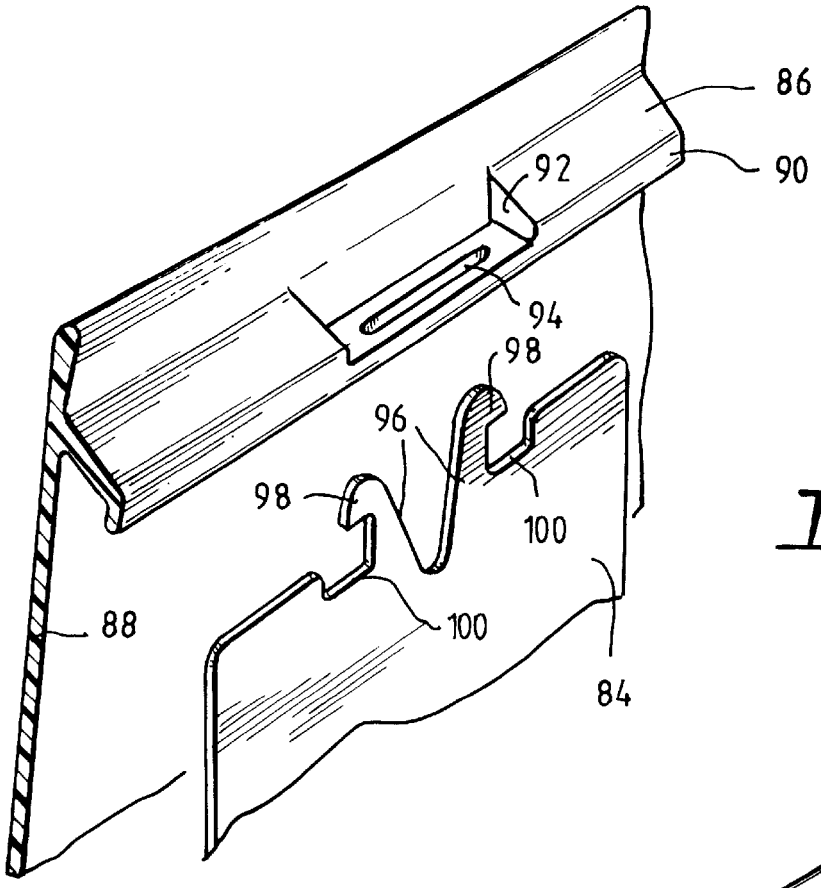
FIG. 8 is a view corresponding to FIG. 1 of a sixth embodiment.

The embodiment of FIG. 8, is a variation of that shown in FIGS. 1 to 3 where there is a tag 84 which is adapted to engage with a rim 86 which is attached to a side wall 88. The rim 86 has a skirt 90 depending therefrom. Rim 86 has a recess portion 92 with an opening 94 therethrough. The tag 84 has opposed, inverted L-shaped projections 96 which have outward projections 98. The projections 96 extend upwardly only a short distance beyond the tag 84 and the recess portion 100 is provided on either side of the projections 96. The operation of the tag 84 and its engagement with the recess portion 92 would be the same generally as the tag 10 with the rim 12 in the embodiment of FIGS. 1 to 3.

Figure 9:
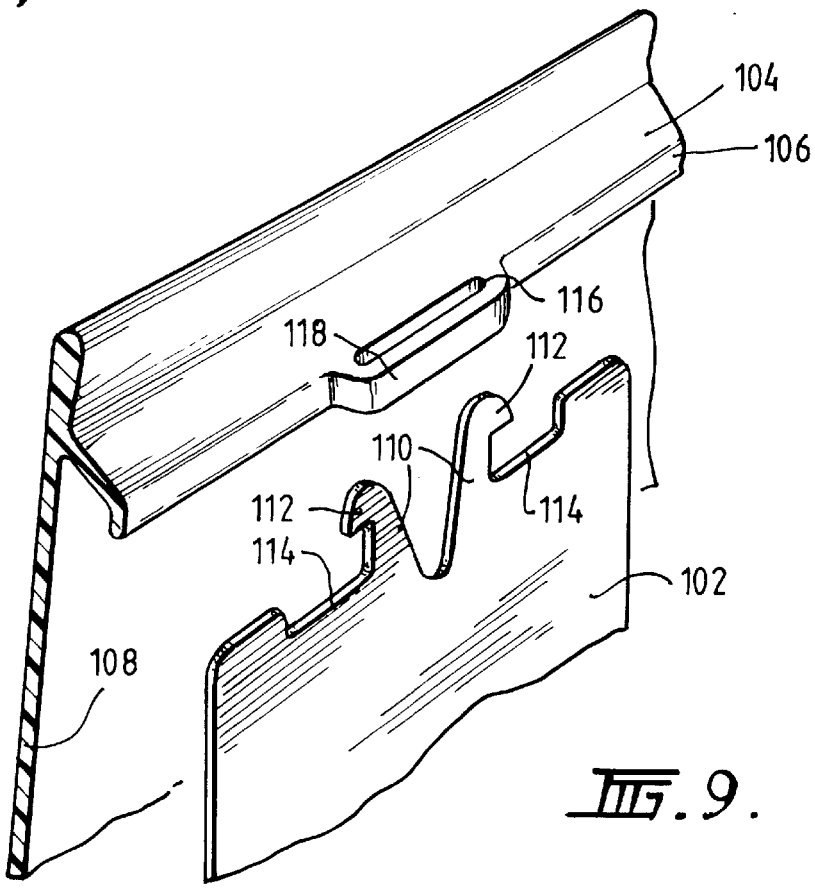
FIG. 9 is a perspective view corresponding to that of FIG. 1 of a seventh embodiment.

In the embodiment of FIG. 9 there is shown yet another variation. Here, there is a tag 102 which is adapted to be releasably engaged with a rim 104, the rim 104 having a skirt 106. The rim is attached to a side-wall 108. This is very much as per earlier embodiments. The tag 102 is generally the same as the tag 84 of the embodiment of FIG. 8 in that it has two opposed inverted L-shape projections 110 with side projections 12 and a recess portion 114 on either side of the projections 110. The projections are adapted to engage through an opening 116 in an extended portion 118 of the rim 104 and skirt 106. The engagement is very much as per the tag 10 of the embodiment of FIGS. 1 to 3, and the tag 84 of the embodiment of FIG. 8.

Figure 10:
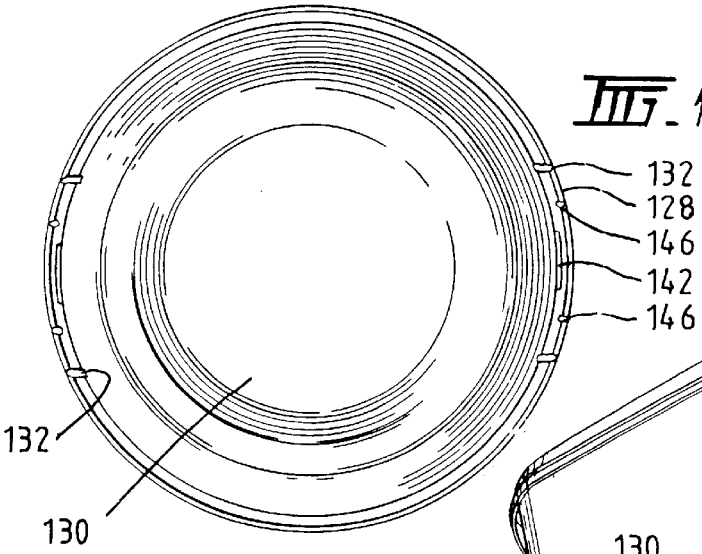
FIG. 10 is an underneath view of a circular container of an eighth embodiment.
Figure 11:
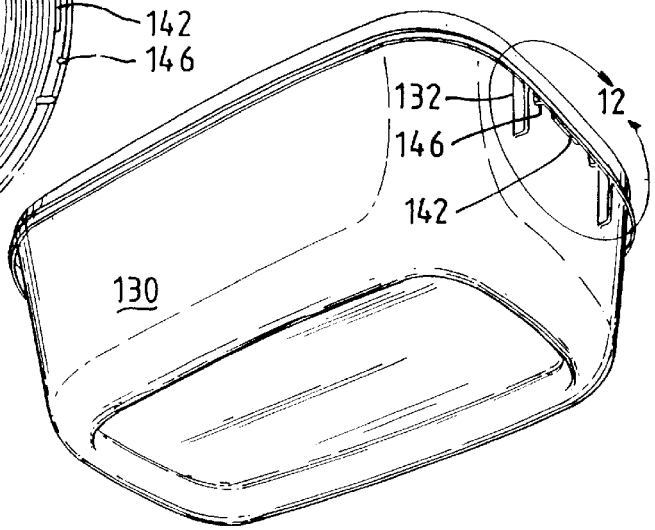
FIG. 11 is an underneath perspective view of an oblong container of an eighth embodiment.
Figure 14:
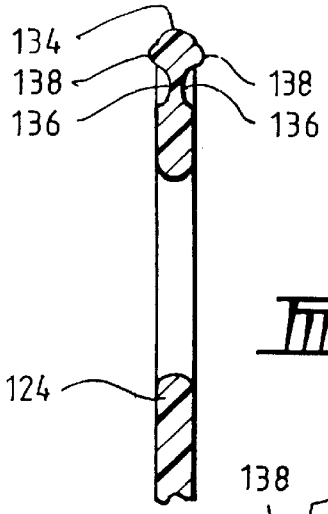
FIG. 14 is a cross-sectional view along and in the direction of arrows 14—14 shown in FIG. 13.

In the embodiment shown in FIGS. 10 through to 17 there is a tag 124 which is adapted to engage with a rim 126 having a skirt 128 and which are attached to a side-wall 130 of a container 129, 131 (FIGS. 10 and 11). However, in this instance, the tag 124 does not engage through an opening. Extending outwardly from the side-wall 130 are stacking ribs 132 which are generally parallel and spaced apart. The stacking ribs 132 extend to the under-surface of the rim 126 and skirt 128. The tag 124 is sized to fit between the stacking ribs 132. Adjacent its leading edge 134, the tag 124 has a elongate recess 136 and, immediately adjacent the recess 136, a corresponding elongate rib 138. On either side of the recess 136 and rib 138 are two triangular or similar shaped openings or recesses 140. The combination of recess 136 and projection 138 is repeated on both sides of the tag 124 so that it is easily reversed.

The side wall 130 also uses an elongate rib 142 extending generally laterally and which is intended to engage in the recess 136 with the rib 138 extending immediately above the rib 142. In this way the tag 124 engages under the rim 126 in the manner of a snap-fit. If desired, further ribs 146 may be provided so as to assist in the location of the tag 124 under the rim 126 and also to assist in forcing the tag 124 to adopt the shape of side-wall 130. In this way the tag 124 will follow the shape of the side-wall, and tend to conform to that shape and be attached to the side wall in a relatively secure, but readily releasable, manner.

Figure 16:
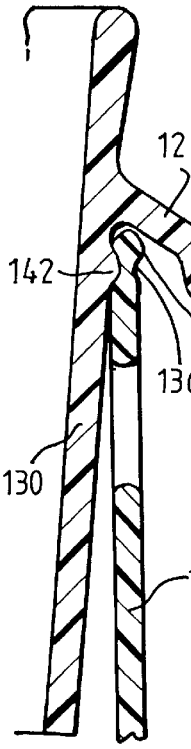
FIG. 16 is a cross-section view along and in the direction of arrow 16—16 shown in FIG. 15.
Figure 17:
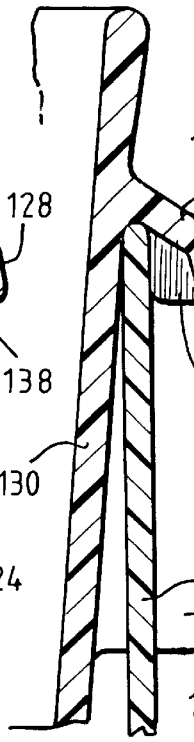
FIG. 17 is a cross-sectional view along and in the direction of arrows 17—17 shown in FIG. 15.
Figure 18:
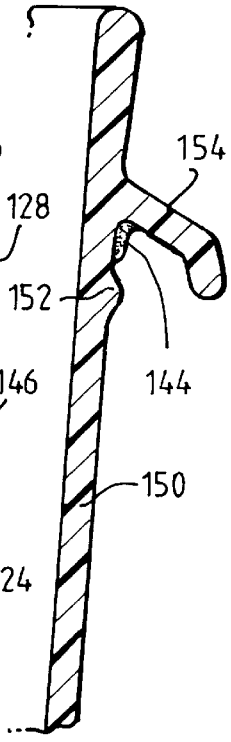
FIG. 18 is a similar view to that of FIG. 16 of a variation of the container shown in FIG. 16.

FIG. 18 shows a variation to that shown in FIG. 16 with a pad 144 being provided on the side-wall 150. Rib 152 is accordingly shifted downwards compared with rib 142 shown in FIG. 16. Pad 144 will assist in guiding indicator tag 124 to the required position and will prevent engagement of tag 124 with rim 154.

Figure 13:
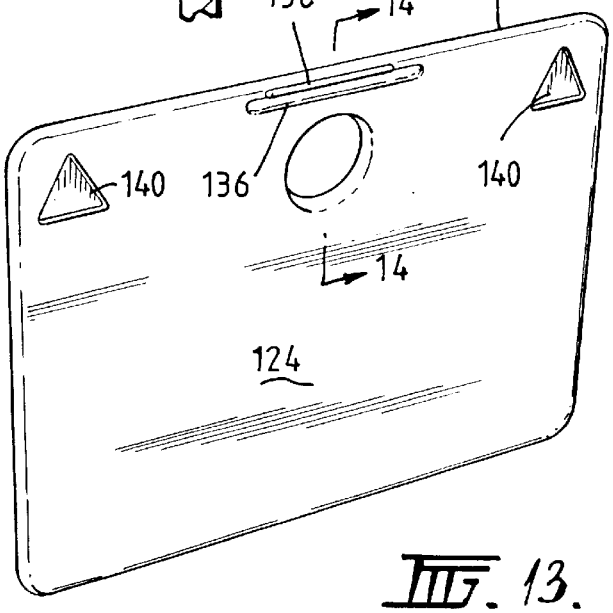
FIG. 13 is a perspective view of an indicator tag for use with the containers shown in FIGS. 10 and 11.
Figure 12:
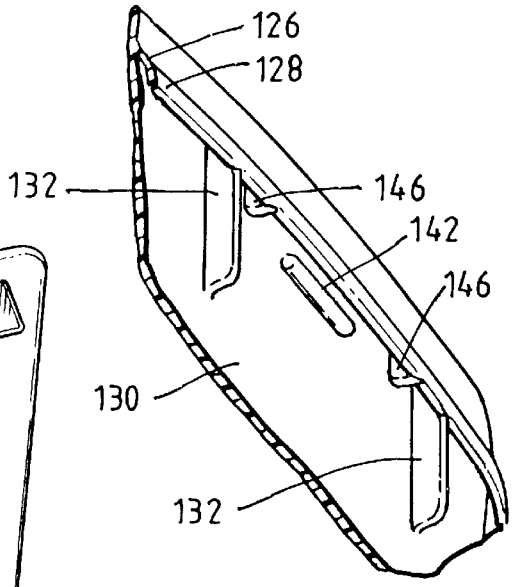
FIG. 12 is an enlarged view of the area indicated by the reference numeral 12 as shown in FIG. 11.
Figure 15:
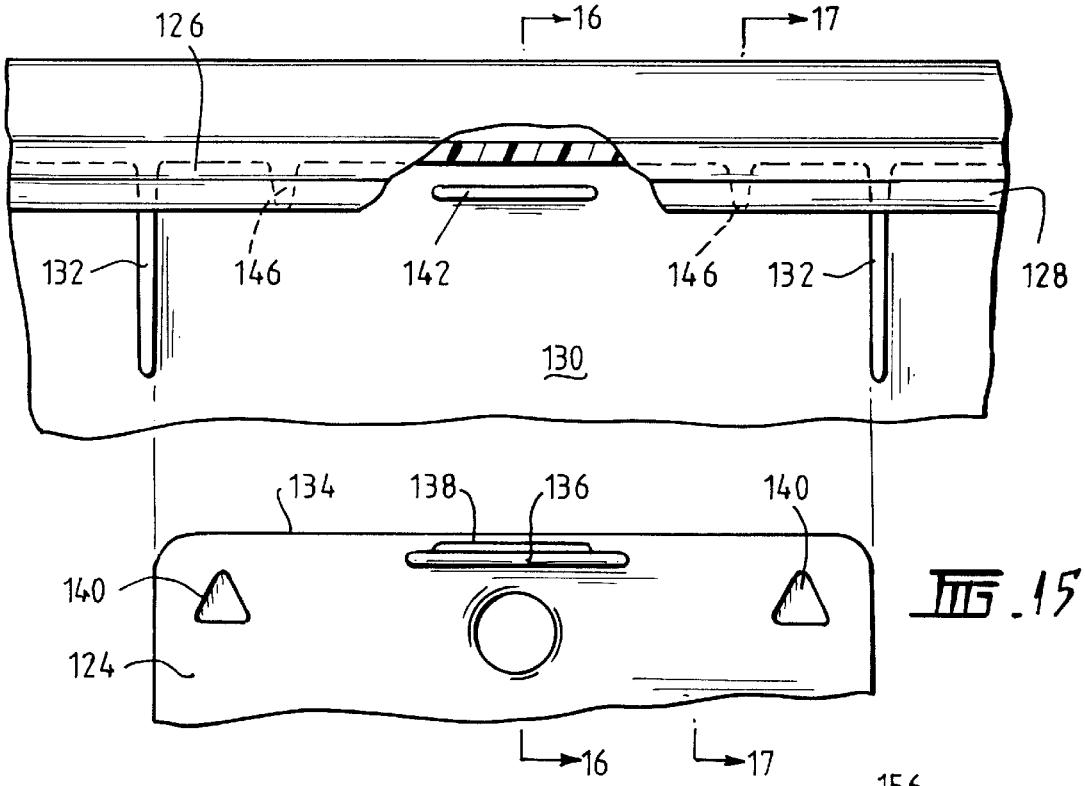
FIG. 15 is a partial cross-sectional front view of the container shown in FIG. 11 together with the indicator tag shown in FIG. 13.
Figure 19:
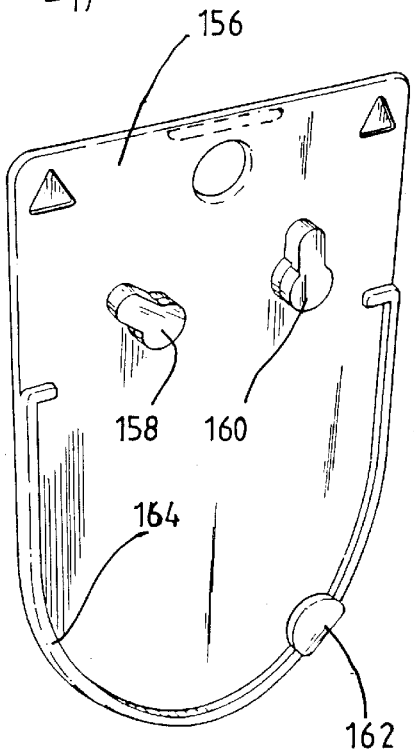
FIG. 19 is a variation of the indicator tag shown in FIG. 13.

FIG. 19 shows a variation of indicator tag 124 shown in FIG. 13. Indicator tag 156 has a number of rotatable dials 158, 160 which may be used to indicate predetermined criteria e.g. day, month. A slider 162 can also be clipped to a rail 164 which may indicate any useful property of the contents of the container.

Figure 20:
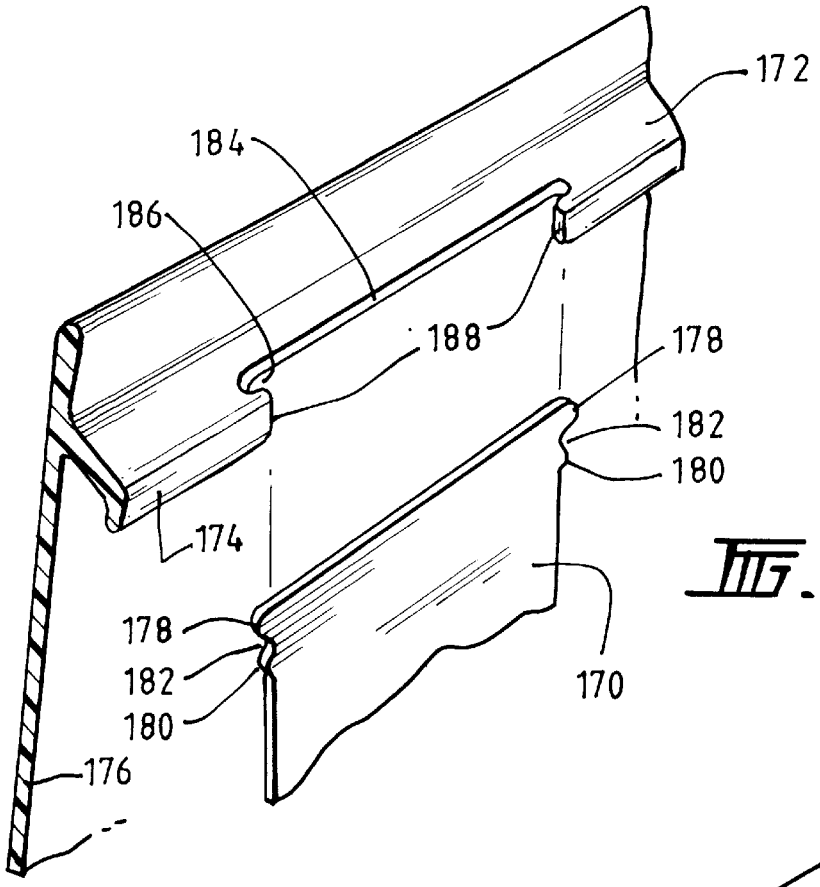
FIG. 20 is an exploded perspective view of a ninth embodiment of an indicator tag attached to a container.

In FIG. 20 there is shown a variation of the embodiment shown in FIG. 9. A tag 170 is adapted to be releasably engaged with a rim 172 which has a skirt 174. The rim 172 is attached to a side-wall 176. Tag 174 has a pair of protrusions 178, 180 which form a notch 182 between them. Rim 172 has a slot 184 which is open at the front by a cut out 186. The cut out is defined by two opposing lugs 188. In use, tag 170 is pushed into slot 184 until notch 182 snap locks onto rim 172.

Figure 21:
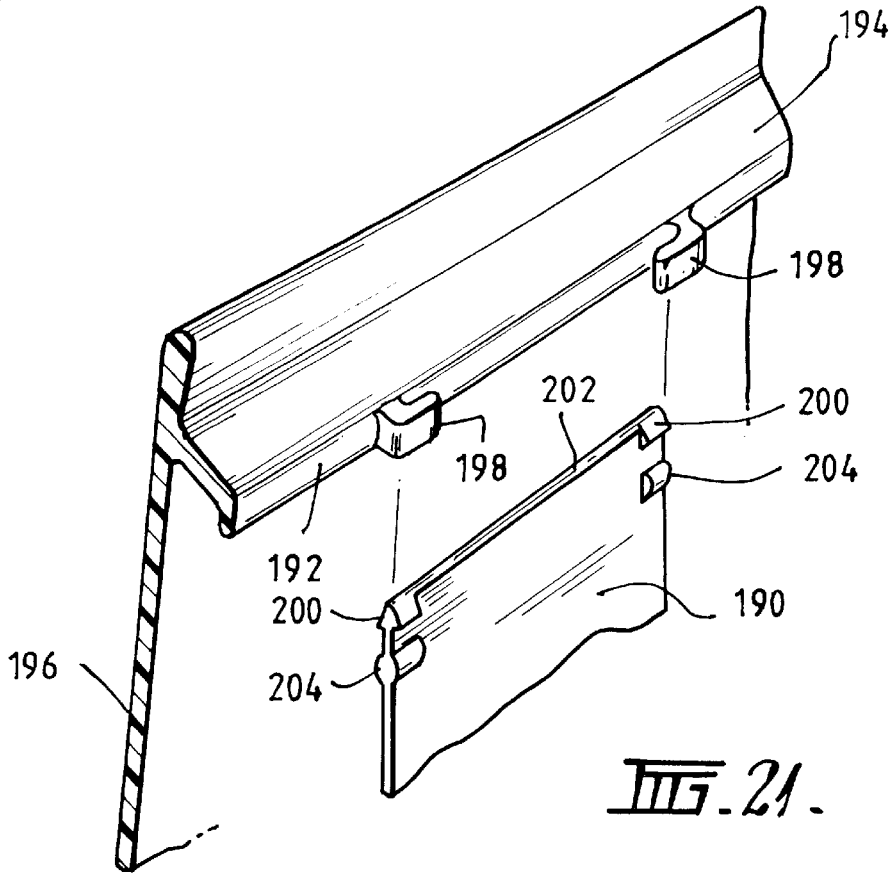
FIG. 21 is an exploded perspective view of a tenth embodiment of an indicator tag attached to a container.

In FIG. 21a variation of the embodiment of FIG. 20 is shown. A tag 190 is adapted to be releasably engaged with skirt 192 of a rim 194 on side-wall 196. A pair of L-shaped lugs 198 are integrally attached to skirt 192. Tag 190 has barbs 200 at end 202 and a pair of lugs 204 adjacent thereto. In use, tag 190 can be pushed into or pushed upwards to engage lugs 198 between barbs 200 and lugs 204.

Figure 22:
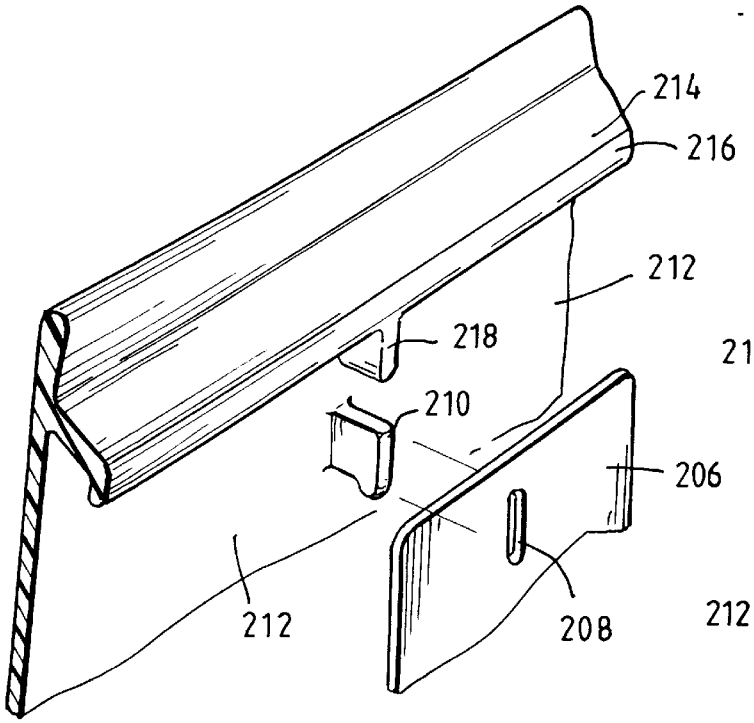
FIG. 22 is an exploded perspective view of an eleventh embodiment of an indicator tag attached to a container.
Figure 23:
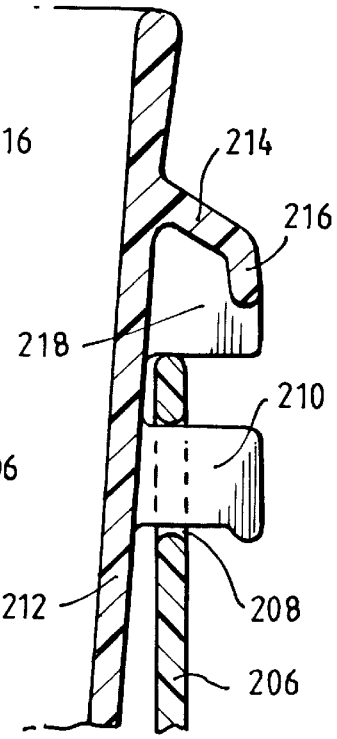
FIG. 23 is a cross-sectional view of the embodiment shown in FIG. 22.

In the embodiment shown in FIGS. 22 and 23 a tag 206 has a slot 208 which engages over a hook member 210 on side-wall 212. A rim 214 projects from side-wall 212 and has a skirt 216 at the free end thereof. To prevent rotation of tag 206 a rib 218 is located under rim 214.

Figure 24:
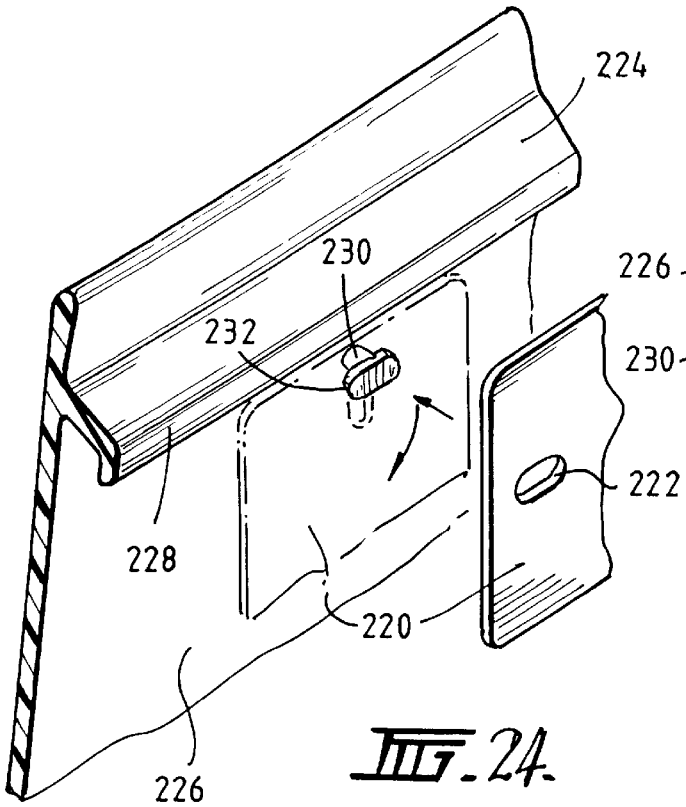
FIG. 24 is an exploded perspective view of a twelfth embodiment of an indicator tag attached to a container.
Figure 25:
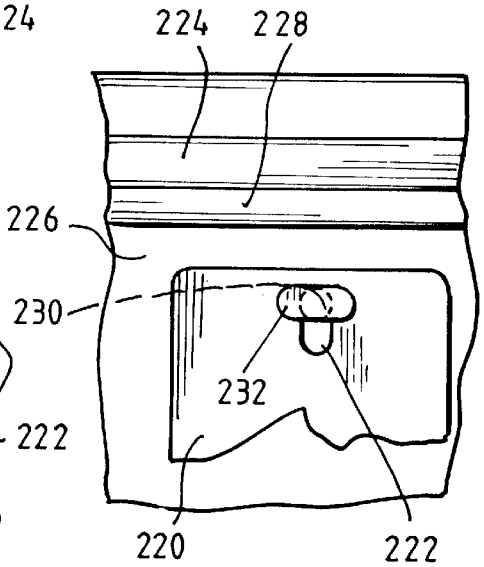
FIG. 25 is a front view of the embodiment shown in FIG. 24.

In the embodiment shown in FIGS. 24 and 25 a tag 220 has a slot 222. A peripheral rim 224 extends from side-wall 226 and has a skirt 228 at the free end thereof. A stub 230 projects from side-wall 226 and has a button 232 secured transversely thereto. Button 232 has a complementary shape to that of slot 222. As shown in FIG. 24 tag 220 is oriented so that slot 222 is oriented with respect to button 232 and tag 220 pushed onto stub 230. Tag 220 can then be swung down into a position transverse to the mounting position as shown in FIG. 25. In this embodiment tag 220 will be in a free swinging position if sufficient clearance is provided between stub 230 and slot 222.

Tag 220 may be flexible, as in the embodiment shown in FIGS. 24 and 25, or, if rigid then stub 230 is moved further down side-wall 226 to allow tag 200 to be turned below rim 224, or, side-wall 226 does not carry a rim 224.

In each instance the tag 10, 36, 50, 64, 76, 84, 102, 124, 156, 170, 190, 206 and 220 may be made of any suitable material such as, for example, a plastics material having a surface such that it can be written upon with a ball-point pen, felt-tip pen, fountain pen, pencil or any other suitable writing implement. In addition, the tags may have placed thereon certain set information such as, for example, normal contents of containers. This could be words such as "sugar", "flour", "primulas", "herbs", or otherwise. As an alternative, the tag may have thereon tabs intended for removal or addition so that the day, month and year can be clearly shown.

When mechanical indicators are used, the tag may be able to be attached to a spike, or have an integral spike, so that it can be placed directly into the potting mix for a potted plant, or in the soil for a plant in the garden, and the desired character or other data recorded. This may be, for example, when the plant was last watered, or any other suitable or required data.

In this way, it is clear that the tags can be easily attached and removed from the containers so that a person can write upon the tag or otherwise indicate its contents, any relevant date, date of insertion, or the like, and the attach the tag to the container. The container can be used with or without the tag, and the one tag can be used with varying containers. By virtue of the nature of the tag, it is easily used, and will not cause difficulties in washing the container.

While there has been described in the foregoing description preferred embodiments of a tag for use with containers, and those containers, it will be realised by those skilled in the technical field concerned that many variations or modifications and details of design or construction may be made without departing from the essence of the present invention.

I claim:

1. A domestic container or canister having an open mouth and a lid for sealably closing said container or canister over said open mouth, an external peripheral rim on said container adjacent said mouth, an indicator tag adapted to receive information on the contents of the container, said indicator tag including a first co-operating means at one end or adjacent one end adapted to be associated with a second co-operating means under said rim, said first and second co-operating means allowing said indicator tag to be releasably attached to said domestic container or canister, said first co-operating means including a recess and said second co-operating means including a complementary rib in the side wall of said container or canister and at least one resilient rib is provided under said rim to force said complementary rib into said recess.

2. The domestic container or canister of claim 1, further including at least a pair of stacking ribs which link said rib to said container or canister, whereby the distance between said stacking ribs substantially corresponds to the width of said indicator tag.

3. The domestic container or canister of claim 1, wherein said rim includes a skirt depending therefrom, said skirt limiting outward movement of said indicator tag from said container or canister.

4. The domestic container or canister of claim 1, wherein said rim is angled towards the bottom of said container or canister.

* * * * *